US006116341A

United States Patent [19]

Stuebinger et al.

[11] Patent Number: 6,116,341

[45] Date of Patent: Sep. 12, 2000

[54] WATER INJECTION PRESSURIZER

[75] Inventors: Lon A. Stuebinger, Littleton, Colo.; Loren K. Barritt, Green River, Wyo.; Kristine H. Brindle, Castle Rock, Colo.; Howard L. McKinzie, Sugar Land, Tex.

[73] Assignee: Texaco Inc., White Plains, N.Y.

[21] Appl. No.: 09/086,592

[22] Filed: May 29, 1998

[51] Int. Cl.[7] ..... E21B 43/38; E21B 43/40

[52] U.S. Cl. ..... 166/265; 166/369; 166/105.5; 166/110

[58] Field of Search ..... 166/265, 369, 166/105.5, 106, 108, 110

[56] References Cited

U.S. PATENT DOCUMENTS

| | | | |
|---|---|---|---|
| 4,766,957 | 8/1988 | McIntyre . | |
| 5,176,216 | 1/1993 | Slater et al. . | |
| 5,335,732 | 8/1994 | McIntyre . | |
| 5,425,416 | 6/1995 | Hammeke et al. . | |
| 5,497,832 | 3/1996 | Stuebinger et al. | 166/369 |
| 5,579,838 | 12/1996 | Michael . | |
| 5,697,448 | 12/1997 | Johnson | 166/106 |

OTHER PUBLICATIONS

Miller, *The American Oil & Gas Reporter*, Jan. , 1997, p. 76–80.

Miller, *The American Oil & Gas Reporter*, Mar., 1997, p. 106–109, 132.

Stuebinger et al., SPE Paper No. 38790, Society of Petroleum Engineers, 1997, pp. 1–10.

MBC Inc., *Introducing a Concurrent Process of Gas Production/Water Disposal*, 10 pages.

Reda, *Downhole Dewatering Systems*, 6 pages, 1997.

Chriscor, a division of IPEC Ltd., *Chriscor Downhole Water Injection Tool*, 6 pages.

*Primary Examiner*—William Neuder

*Attorney, Agent, or Firm*—Harold J. Delhommer; Howrey & Simon

[57] ABSTRACT

The present invention relates to an apparatus and a method for multiplying the hydrostatic head of a column of liquid into a magnified injection pressure for injecting water produced in a gas well into a disposal zone, while concurrently producing the gas, with little or no water, to the ground surface.

23 Claims, 6 Drawing Sheets

WATER INJECTION PRESSURIZER

FIELD OF THE INVENTION

The present invention relates to an apparatus and method for injecting water subsurface in a well. In particular, the present invention relates to an apparatus and method for injecting water produced in a gas well into a disposal zone while simultaneously producing the gas, with little or no water, to the ground surface.

BACKGROUND OF THE INVENTION

Conventional gas production wells have been constructed in subterranean strata that yield both hydrocarbons, such as gas, and an undesired amount of liquid, such as, for example, water or salt-water. The wells are usually lined with heavy steel pipe called "casing" which is cemented in place so that fluids cannot escape or flow along the space between the casing and the well bore wall. In some wells, large amounts of water are produced along with the gas from the onset of production. Alternatively, in other wells relatively large amounts of water can be produced as gas production is increased.

The production of excess water to the ground surface results in associated costs in both the energy to lift, or "produce," as well as the subsequent handling of the excess produced water after it has arrived at the surface. Moreover, the produced water must be disposed of after it has been brought to the ground surface. Surface handling of excess water, in addition, creates risks of environmental pollution from such incidents as broken lines, spills, overflow of tanks, and other occurrences. Many gas production fields and wells often rapidly become uneconomic to produce because of excessive water production.

Various apparatuses and methods have been proposed to overcome the problems associated with excess water production and the aforementioned problems associated with lifting, or producing, this water to the ground surface. Several approaches have emphasized more effective and efficient means to bring the produced water to the surface. Among these means are: smaller tubing sizes to improve lift; use of foaming agents; or installation of mechanical lift methods. These approaches, however, have not recognized that effective removal of liquid from gas wells can be accomplished by transferring the accumulated liquids subsurface to a water-absorbing disposal formation.

An evolving approach to the problems of excess water is to separate the excess water from the gas in the production well below the ground surface and allow the gas to migrate to the ground surface. The excess water is then conveyed downwardly through the well bore where it is discharged into a disposal formation of the subterranean strata. Such an approach has generally been referred to as an "in-situ" disposal method.

Generally, in-situ methods have required the availability of a suitable disposal formation, either below or above the production zone, with sufficient permeability to permit disposal of the excess water into the disposal formation. In addition, these methods have generally been used where the injection pressure gradients of the candidate disposal formations were either low or moderate (i.e., less than 0.5 psi per foot of depth). Practical limitations of the existing equipment and prohibitive costs associated with more expensive and complex pumping equipment have usually restricted use of these in-situ methods where a higher injection pressure gradient field has been encountered.

In an example of a conventional production apparatus of the in-situ type, a coupled rod pump is used for separating and producing oil from water in a well, while simultaneously disposing of the water into the producing formation or into a disposal formation below the producing formation. Such an apparatus is shown in U.S. Pat. No. 5,697,448. The apparatus employs three spaced packers (upper, middle, and lower). An oil pump is located between the upper and middle packers, and a water pump is located between the middle and lower packers. Produced oil and water are accumulated between the upper and middle packers. The oil is delivered through an opening into the oil pump and fills a cylinder associated with the oil pump. Produced water is allowed to drain through additional passages into the water pump cylinder where it accumulates for disposal. Selective pumping of the oil on the upstroke of the pump and the water on the downstroke of the pump is effected by a set of check valves associated with both the oil and water pumps.

The foregoing conventional in-situ apparatus does not solve all of the problems associated with excess water production. This apparatus does not address the problems associated with injecting excess water into disposal formations with excessive injection pressure gradients. Moreover, such an apparatus, if used in a gas production well, would most likely present gas/water separation efficiency problems given that the gas would first have to pass into the upper pump (oil pump) chamber instead of allowing the gas to vent to the ground surface.

In another example of an in-situ type apparatus, a formation injection tool, mounted to a bottom-hole tubing pump, carries out underground separation and down-bore in-situ transport and disposal of the undesired fluids into a disposal formation in the production well. Such an apparatus is shown in U.S. Pat. No. 5,425,416. In order to overcome the often-encountered moderate to high injection pressures of disposal zones, this apparatus requires the use of one or more sinker bars placed above the pump to provide the extra force necessary to overcome the injection pressure opposing the downward movement of the pump. In instances where shallow disposal zones are encountered, this apparatus requires that four or more sinker bars be used above the pump. This not only presents more expensive lifting equipment above the pump, but also adds to the overall complexity and cost of the pumping system.

In a further example of the in-situ approach, a dual action pumping system produces oil and water from the annulus on the upstroke of the pump, while injecting water on the downstroke, using gravity segregation. Such an apparatus is shown in U.S. Pat. No. 5,497,832. However, in order to overcome the often-encountered moderate to high injection pressures of disposal zones, this apparatus also requires the use of one or more sinker bars placed above the pump to provide the extra force necessary to overcome the injection pressure opposing the downward movement of the pump.

Thus, there is a need in the art for an apparatus and method that substantially obviates one or more of the limitations and disadvantages of conventional pumping systems. Particularly, there is a need for a system for allowing produced gas to vent or flow upwardly to the ground surface, while precluding produced water from being lifted to the surface. There is a particular need for such a system for disposal zones having moderate to high injection pressure gradients.

SUMMARY OF THE INVENTION

The present invention solves the problems with, and overcomes the disadvantages of, conventional pumping systems for injecting water below a gas-producing zone. The present invention provides an apparatus and method for multiplying a hydrostatic head of a column of liquid into a magnified injection pressure for injecting water, which is produced concurrently with gas in a producing zone traversed by a subterranean well, at the magnified injection pressure into a disposal zone while simultaneously producing the gas, with little or no water, to a ground surface. The invention includes a casing having two spaced intervals. The casing extends from the ground surface downwardly within the subterranean well such that a first of the two spaced intervals communicates with the producing zone of a subterranean strata, and a second of the two spaced intervals communicates with the disposal zone of the subterranean strata. A pump, reciprocable through an upstroke and a downstroke, is disposed in the casing. The pump includes an upper plunger coupled to a lower plunger. The surface area of the upper plunger is larger than the corresponding surface area of the lower plunger.

In another aspect, the invention includes a seal, or packer, that is disposed within the casing between the first and second spaced intervals. The casing and the seal are configured to permit produced water and gas from the producing zone to collect above the seal. The gas and water separate by gravity. As this separation occurs, the gas flows upwardly to the ground surface.

An input is preferably disposed between the lower plunger and the seal. The input is responsive to the upstroke of the pump to permit unidirectional flow of a portion of the produced water into the pump thereby forming a column of produced water below the lower plunger.

In a further aspect of the invention, an output is provided that is in fluid flow communication with the input and the pump. The output is responsive to the downstroke of the pump to permit unidirectional flow of the column of produced water at the magnified injection pressure into the casing below the seal.

Accordingly, the apparatus of the present invention multiplies a hydrostatic head of a column of liquid into a magnified injection pressure for injecting water subsurface within a subterranean well while lifting little or no fluids to the ground surface.

FEATURES AND ADVANTAGES

The invention uses simple, cost-effective hydraulic principles for multiplying a hydrostatic head of a column of liquid in order to substantially increase the pressure applied to the produced water which enables injection of the produced water into disposal zones with moderate to high injection pressure gradients. Moreover, unlike conventional pumping systems, the present invention does not require the use of additional components, like sinker bars, to develop sufficient injection pressures.

The present invention also has applications with respect to waterflooding deeper zones with excess water produced from shallower zones. In typical waterflood applications, water and oil or gas are produced by conventional methods to a battery where it is separated and temporarily stored. Then the water is pumped through a facility into an injection well. The injection wells are either strategically drilled new wells or existing wells which are converted to the purpose. In particular situations, the desired placement of injection wells is not always possible because of limiting economic factors, such as the location and number of idle wells, injection facility size, reservoir size, pipeline location, etc. The present invention may allow small scale floods or pattern reconfiguration, due to the dual utility of the single well bore, without the attendant costs of surface facilities.

Additional features and advantages of the invention will be set forth in the description that follows, and in part will be apparent from the description, or may be learned in practice of the invention.

It is to be understood that both the foregoing general description and the following detailed description are exemplary and explanatory and are intended to provide further explanation of the invention as claimed and not to be limitative thereof.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE INVENTION

Reference will now be made in detail to the present preferred embodiment of the invention, examples of which are illustrated in the accompanying drawings. The exemplary embodiment of this invention is shown in some detail, although it will be apparent to those skilled in the relevant art that some features which are not relevant to the invention may not be shown for the sake of clarity.

Figure 1:
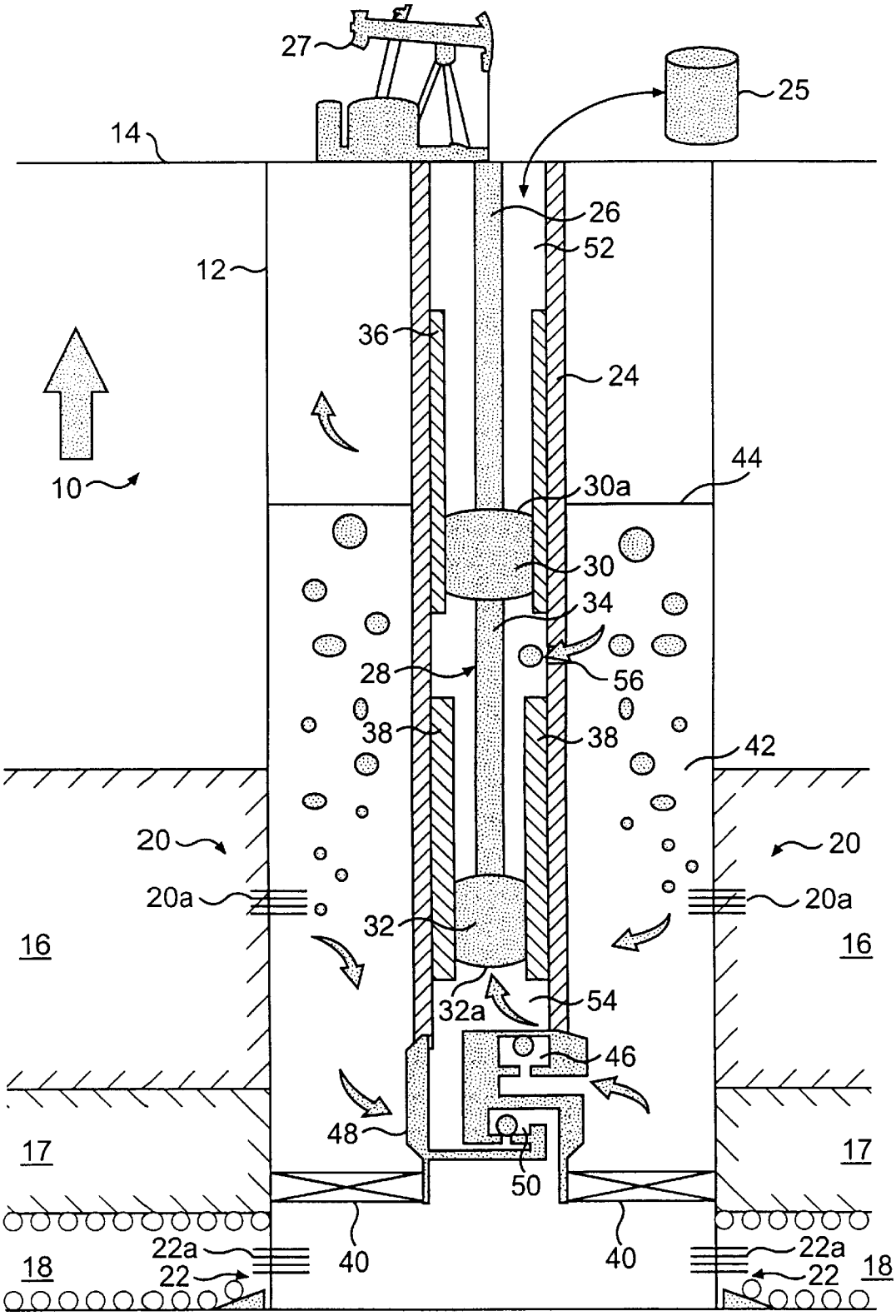
FIG. 1 is a side-elevation sectional view of an embodiment of the present invention shown towards the beginning of its upstroke.

Referring first to FIG. 1, there is illustrated, in a side-elevation sectional view, the exemplary embodiment of the present invention and is represented generally by reference numeral 10. A casing 12 is shown extending from the ground surface 14 downwardly within a subterranean well through a hydrocarbon and water producing zone 16 and then to a water disposal zone 18. It is preferable to have an isolation zone 17 between the producing zone 16 and the injection or disposal zone 18.

As shown in FIG. 1, casing 12 has a producing interval, shown generally at 20, separated from an injection interval, shown generally at 22. Producing interval 20 is located adjacent to and in fluid flow communication with the producing zone 16. In a similar manner, injection interval 22 is located adjacent to and in fluid flow communication with the disposal, or injection zone 18. The producing interval 20 may be for example, but is not limited to, sets of perforations 20*a* in the casing 12. Alternatively, producing interval 20 can be a slotted-liner casing arrangement. Preferably, however, the producing interval 20 will be sets of perforations 20*a* as shown in FIG. 1. Likewise, the injection interval 22 may be, but is not limited to, sets of perforations 22*a* in the casing 12. Alternatively, injection interval 22 can be a slotted-liner casing arrangement. As a further alternative, instead of using injection interval 22, the excess water may be injected directly into an open hole (not shown) within the subterranean strata. Preferably, however, the injection interval 22 will be sets of perforations 22*a* as shown in FIG. 1. It should be readily apparent to one skilled in the art that casing 12 may be provided with multiple producing intervals 20 and injection intervals 22 in communication with the producing zone 16 and the disposal zone 18, respectively. The disposal zone 18 can be the same formation as the producing zone 16 provided that the producing interval 20 and the injection interval 22 are not communicating actively (i.e., fluid flow is isolated between producing interval 20 and injection interval 22).

Casing 12 surrounds a tubing 24 which extends from the ground surface 14 downwardly within the casing 12. A downhole pump, shown generally as 28, is disposed in casing 12. In the embodiment shown in the Figures, pump 28 is disposed within tubing 24. However, it should be understood that the present invention is not limited to having the pump 28 disposed within tubing 24. It should be apparent to one skilled in the art that pump 28 could consist of any combination of modified rod pumps (for example, but not limited to, tubing and insert, insert and insert, and lubriplungers) to provide needed flexibility for varying conditions such as sand, gas, and corrosive conditions. Upper plunger 30 and lower plunger 32 are shown in FIG. 1 as cylindrical in shape, however, it should also be apparent to one skilled in the art that the plungers are not limited to a cylindrical shape.

The pump 28 preferably consists of an upper plunger 30 and a lower plunger 32. Upper plunger 30 preferably has a larger surface area 30*a* as compared to the surface area 32*a* of lower plunger 32. As noted above with respect to the shape of the plungers, the surface areas 30*a* and 32*a* are not limited to a specific shape, although they are preferably circular as shown in FIG. 1. As further shown in FIG. 1, surface area 30*a* is in contact with a column of liquid 52 above upper plunger 30 in tubing 24. Likewise, surface area 32*a* is in contact with a column of produced water 54 below lower plunger 32 in tubing 24. The column of liquid 52 and the column of produced water 54 will be discussed in more detail below.

The upper plunger 30 and the lower plunger 32 are coupled together by connecting rod 34, which is preferably made of steel. Alternatively, connecting rod 34 may be made of any known high compressive strength material. Connecting rod 34 may be connected to upper plunger 30 and lower plunger 32 by any known securing method, for example, but not limited to, threaded connections or welding. The present invention is not limited to the use of a connecting rod for coupling upper plunger 30 and lower plunger 32, and other suitable mechanisms may be used to couple upper plunger 30 and lower plunger 32. Alternatively, the upper plunger 30 and the lower plunger 32 may be coupled directly together (i.e., without a connecting rod 34 therebetween) by any known method, for example, but not limited to, welding.

In the exemplary embodiment shown in FIG. 1, an upper barrel 36 and a lower barrel 38 are disposed in tubing 24. Upper plunger 30 and lower plunger 32 are sealingly disposed in upper barrel 36 and lower barrel 38, respectively. Alternatively, if a tubing pump is used in the present invention, upper plunger 30 and lower plunger 32 are sealingly disposed directly within tubing 24 without the need for upper barrel 36 and lower barrel 38. As noted above, this provides flexibility in terms of pump sizing and injection pressure magnification options. It is to be understood that very little, if any, fluid can pass between the outer sealing edges of upper plunger 30 and upper barrel 36, or tubing 24, or between lower plunger 32 and lower barrel 38, or tubing 24. Any well-known sealing mechanisms may be employed to provide the seal between plungers, 30 and 32, and barrels, 36 and 38, or tubing 24 including, but not limited to o-rings or slip rings.

A conventional rod string 26 is also disposed within tubing 24. Rod string 26 extends to the ground surface 14 where it is reciprocated through an upstroke and a downstroke by a pump drive 27 located at the ground surface 14. Rod string 26 is coupled to upper plunger 30. As discussed above with respect to connecting rod 34, rod string 26 may be coupled to upper plunger 30 by any known securing method, for example, but not limited to, threaded connections or welding. As rod string 26 is reciprocated through an upstroke and a downstroke by the pump drive 27, upper plunger 30 and lower plunger 32, likewise reciprocate through an upstroke and downstroke, preferably resulting in a uniform up and down motion within the tubing 24.

A seal 40 is disposed within casing 12, preferably between producing interval 20 and injection interval 22. Casing 12 and seal 40 are configured to permit produced water to collect above seal 40. Particularly, tubing 24, casing 12, and seal 40, together define a casing-tubing annulus 42 that extends upward to the ground surface 14. Hydrocarbons, such as gas, and water flow or are "produced," into casing 12 through producing interval 20. If during production, pump capacity exceeds the producing zone's 16 water production capacity, then the operator may decrease the pump speed, change the sheaves, put the pump on a timer, or add surface water into the casing-tubing annulus 42 in order to maintain production. The produced gas and water are allowed to collect in annulus 42 above seal 40 and to separate by gravity. This forms a gas/water interface 44 in annulus 42. In this manner, produced gas is allowed to flow upwardly within annulus 42 to the ground surface where it is subsequently collected in a well-known manner.

An input 46 is preferably disposed at a lower end of tubing 24 between lower plunger 32 and seal 40. As shown in the exemplary embodiment in FIG. 1, input 46 may be a caged ball valve which is assembled as an upper valve of a valve assembly, shown generally as 48, having an upper and lower portion. Valve assembly 48 is shown as being preferably connected to the lower end of tubing 24 and to seal 40. It is to be understood, however, that valve assembly 48 may be disposed anywhere below the pump 28 provided that it is placed lower than the producing interval 20 but above the seal 40. This placement could range from just a few feet to thousands of feet deeper in the well than the pump 28 itself.

In the embodiment shown in the Figures, output 50 is disposed at a lower end of tubing 24 below input 46 and is in fluid flow communication with pump 28 and with input 46. As would be readily apparent to one of ordinary skill in the relevant art, input 46 and output 50 can be configured in other arrangements and relative positions. It should be acknowledged that the present invention is not limited to the configuration of input 46 and output 50 shown in the Figures. For example, input 46 and output 50 may be configured in a side-by-side arrangement.

As shown in the exemplary embodiment, fluid flows between input 46 and output 50 in a serpentine path, however, other fluid flow paths may alternately be used. Output 50 is shown in the exemplary embodiment of FIG. 1 as a caged ball valve assembled as a lower valve of valve assembly 48. It will be apparent to those skilled in the art that other types of flow control devices could be used as input 46 or output 50. Preferably, however, input 46 and output 50 are caged ball valves and will be referred to below as upper ball valve 46 and lower ball valve 50, respectively. Operation of upper ball valve 46 and lower ball valve 50 will be shown in more detail below.

In order to effect the injection of the produced water, at an elevated injection pressure, into the casing 12 below seal 40 and thereafter into disposal zone 18, a column of liquid 52 is provided in tubing 24 above upper plunger 30. The liquid may be fresh water, brine (saltwater), or any other suitable liquid. Preferably, however, the liquid is brine. The column of liquid 52 provides a hydrostatic head which is multiplied, as will be described in more detail below, to substantially increase the pressure applied to the produced water which is to be injected into the casing 12 below seal 40 and thereafter into the disposal zone 18. It should be apparent to one skilled in the art that the hydrostatic head provided by the column of liquid 52 is dependent upon the hydrostatic pressure gradient of the particular fluid selected and the height of the column of liquid 52 in tubing 24 above upper plunger 30.

Figure 2:
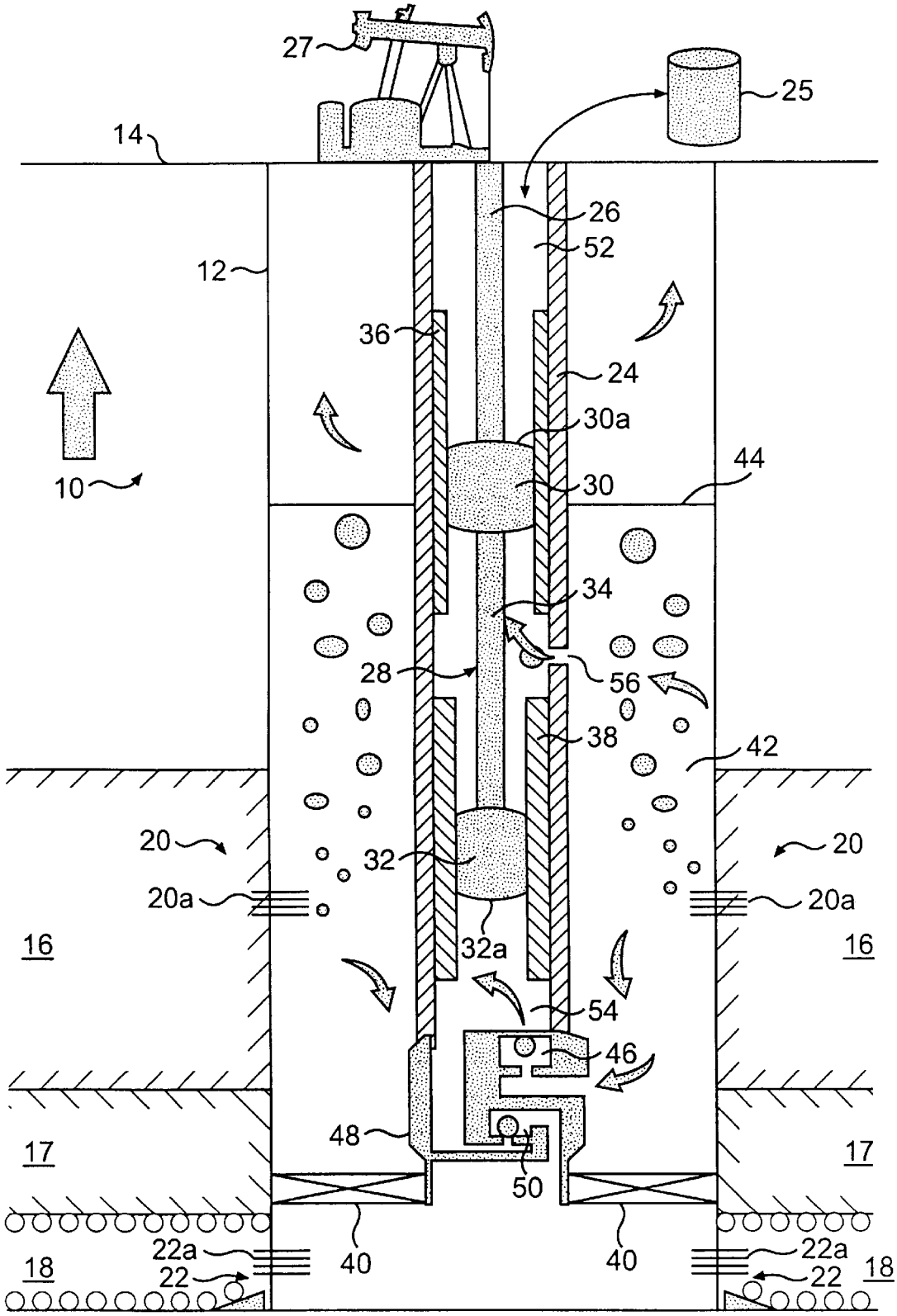
FIG. 2 is a side-elevation sectional view of the embodiment of FIG. 1 shown towards the middle of its upstroke.
Figure 3:
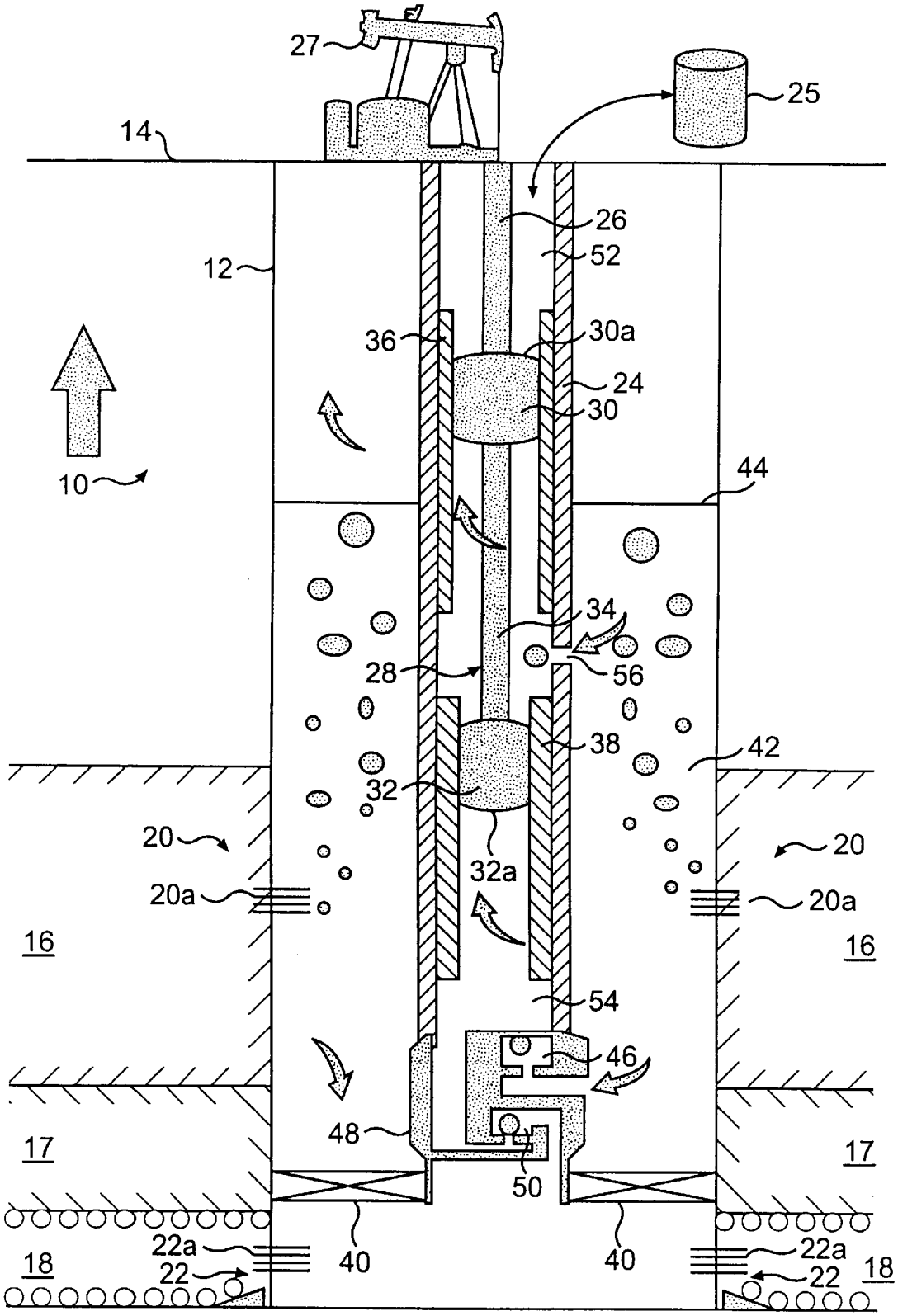
FIG. 3 is a side-elevation sectional view of the embodiment of FIG. 1 shown towards the end of its upstroke.

Referring now to FIGS. 1, 2, and 3 simultaneously, the upstroke of the exemplary embodiment is shown. At the beginning of the upstroke of pump 28, lower ball valve 50 closes because the pressure being exerted by the disposal or injection zone 18 below seal 40 in casing 12 is greater than the total pressure within tubing 24 below lower plunger 32. This in effect seals off the injection/disposal zone below seal 40. During the upstroke, upper ball valve 46 opens to permit a portion of the produced water to enter pump 28 within tubing 24. The produced water accumulates below lower plunger 32 forming a column of produced water 54. Additionally, a portion of the produced water enters a port 56 disposed in tubing 24 between upper plunger 30 and lower plunger 32. This action continues, as shown in FIGS. 2 and 3, as rod string 26 lifts the pump 28 within tubing 24.

Preferably, although not mandatory, a surge tank 25 is provided at the ground surface 14. The surge tank 25 is in fluid flow communication with tubing 24. The surge tank 25 acts as a buffer for the column of liquid 52 such that during the upstroke of pump 28, any of the liquid expelled from tubing 24 above upper plunger 30, enters the surge tank 25 and subsequently is allowed to go back into the tubing 24 during the downstroke of pump 28. This, in effect, maintains the height of the column of liquid 52, and consequently the hydrostatic head above upper plunger 30. Surge tank 25 also provides a simple method for monitoring pump performance, such as pump slippage. Pump slippage or other factors may require supplementing the liquid in the surge tank 25 in order to maintain the column of liquid 52 in tubing 24.

Figure 4:
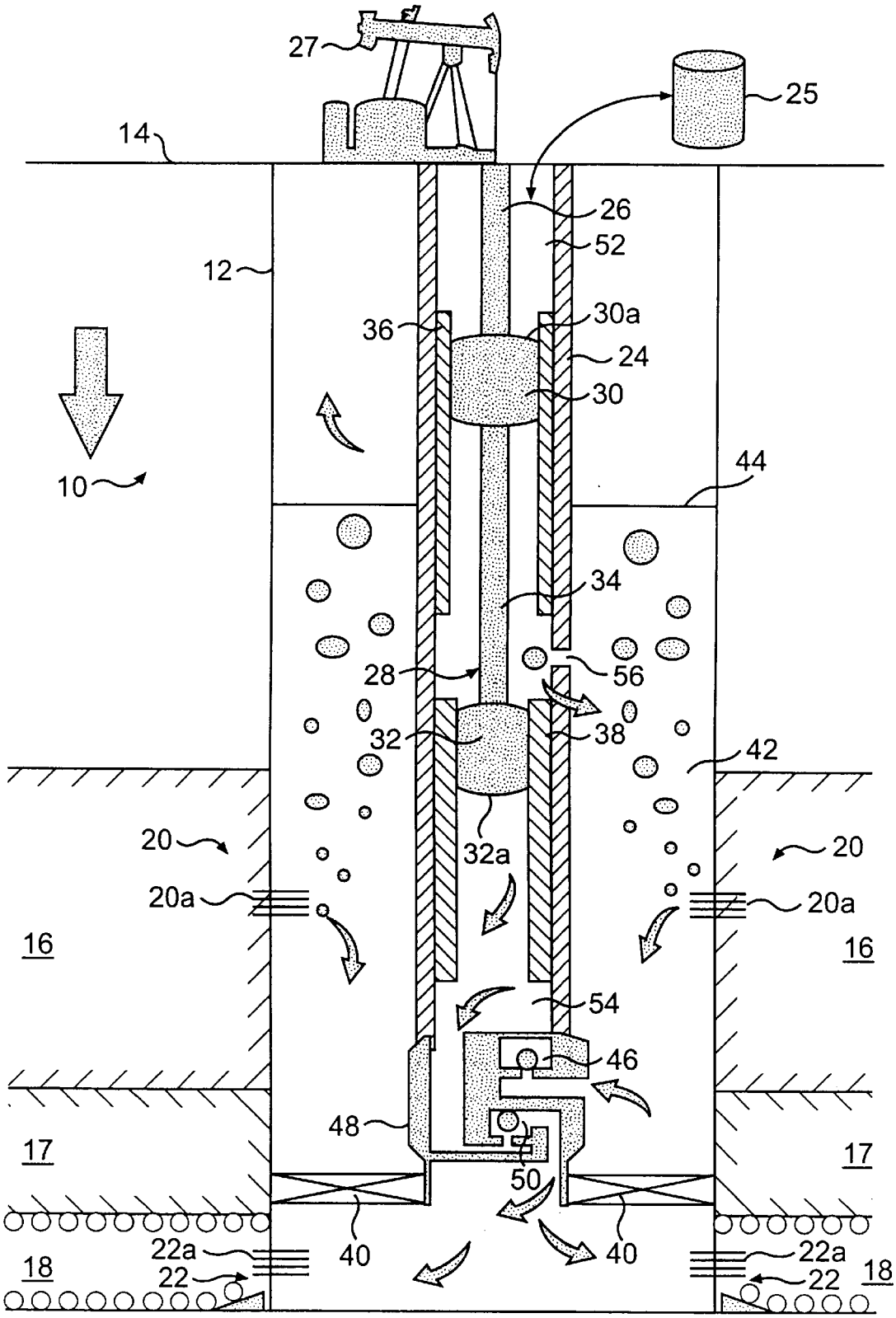
FIG. 4 is a side-elevation sectional view of the embodiment of FIG. 1 shown towards the top of its downstroke.
Figure 5:
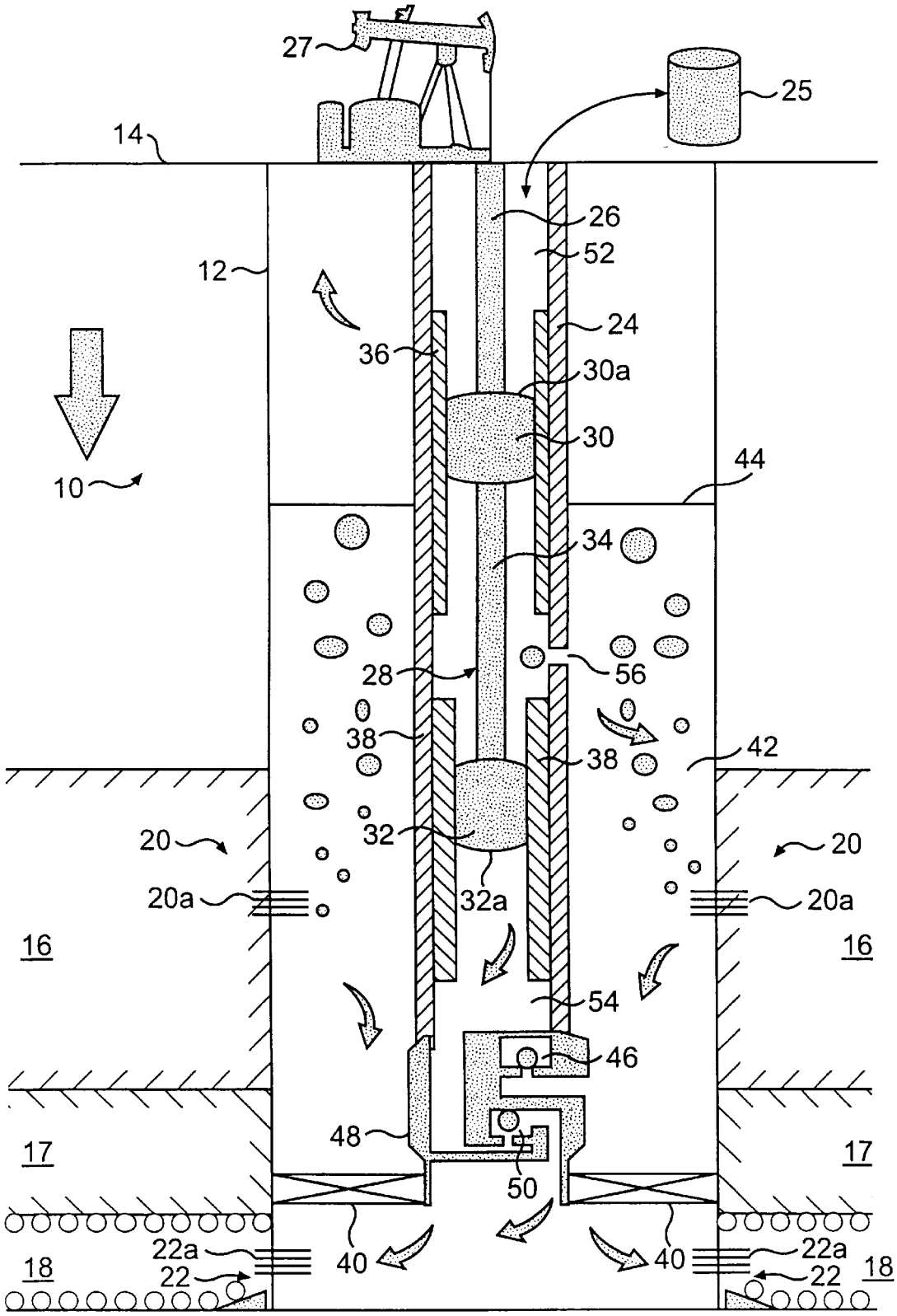
FIG. 5 is a side-elevation sectional view of the embodiment of FIG. 1 shown towards the middle of its downstroke.
Figure 6:
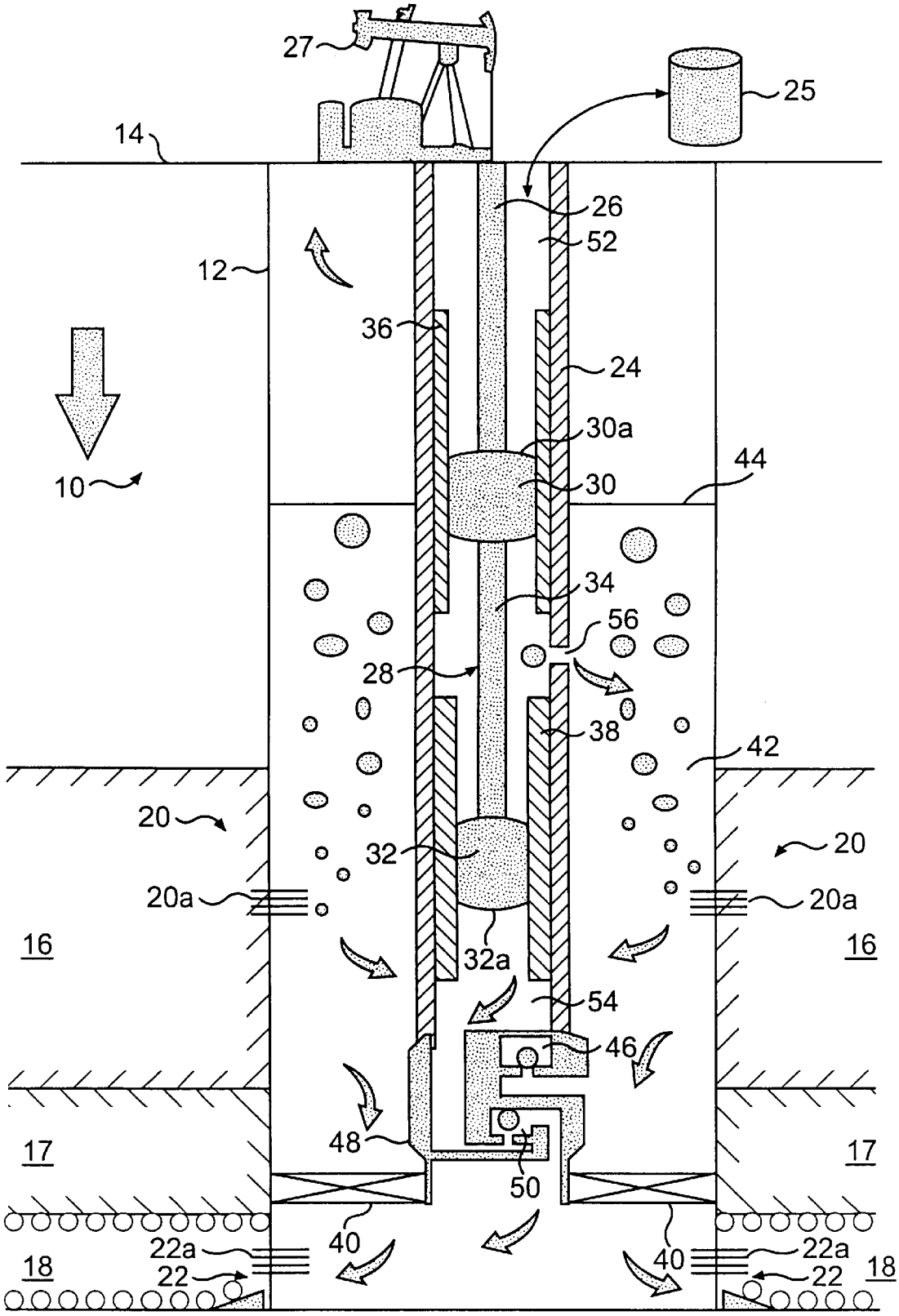
FIG. 6 is a side-elevation sectional view of the embodiment of FIG. 1 shown towards the bottom of its downstroke.

Referring now to FIGS. 4, 5, and 6 simultaneously, the downstroke of the exemplary embodiment is shown. At the top of the downstroke (FIG. 4), upper ball valve 46 closes and lower ball valve 50 opens due to the high pressure generated by bottom plunger 32 acting on the column of produced water 54. During the downstroke, the hydrostatic head of the column of liquid 52 above upper plunger 30 acts across its surface area 30*a* and this pressure is converted into a downward force in a well known manner (i.e. pounds/square inch*square inches=pounds). This downward force is added to the force imparted by rod string 26 and is transferred to connecting rod 34. The force is then transferred through connecting rod 34 to bottom plunger 32. The force is converted back to a higher pressure, or magnified injection pressure, when the smaller surface area 32*a* of the bottom plunger 32 acts on the column of produced water 54 below. As mentioned above, lower ball valve 50 is open during the downstroke thereby permitting the column of produced water 54 to exit at the magnified injection pressure via lower ball valve 50 into casing 12 below seal 40 and thereafter into the disposal zone 18. Also during the downstroke, a portion of the produced water that entered port 56 between upper plunger 30 and lower plunger 32 during the upstroke is expelled through port 56 on the downstroke. This action continues, as shown in FIGS. 5 and 6, until the bottom of the downstroke is reached.

To more clearly describe the injection pressure magnification process, the following example is given. It is to be understood that the calculations shown below describe the primary factors involved in calculating the magnified injection pressure. As would be apparent to one of ordinary skill in the art other secondary factors, such as buoyancy, casing pressure, and the dynamic effects of the connecting rod may affect the magnified injection pressure. This example should not represent any limitation on the present invention. Corresponding reference numerals will be used where appropriate.

Consider a hydrocarbon-producing well located in a particular field wherein the producing zone 16 is located approximately 2,500 feet from the surface. Brine is preferably used as the fluid that will form the column of liquid 52 above upper plunger 30. The height of the column of brine 52 is maintained at 2,500 feet, as described above, by a surge tank 25 located at the ground surface 14. Assuming the hydrostatic pressure gradient of brine is approximately 0.45 psi/foot, the resultant pressure exerted by the column of brine 52 at the upper plunger 30 is 1,125 psi (2,500 feet*0.45 psi/foot=1,125 psi). Assume upper plunger 30 has a diameter of 3 inches and lower plunger 32 has a diameter of 2 inches. The corresponding surface area 30*a* of the upper plunger 30 is therefore $7.07 in^2(\pi*(3\ in/2)^2=7.07\ in^2)$. Similarly, the corresponding surface area 32*a* of the lower plunger 32 is $3.14\ in^2(\pi*(2\ in/2)^2=3.14\ in^2)$. As described above, during the downstroke of the pump 28, the hydrostatic head (1,125 psi) acts across surface area 30*a* of upper plunger 30 and is converted into a Force (Force=Head*Surface Area 30*a*=1,125 psi*7.07 $in^2$: Force=7,954 pounds). This Force is then transferred through connecting rod 34 where it is converted back into a magnified injection pressure when the smaller surface area 32*a* of bottom plunger 32 acts on the column of produced water 54 below (Magnified Injection Pressure=Force/Surface Area 32*a*=7,954 pounds/3.14 $in^2$: Magnified Injection Pressure=2,533 psi). Thus, the hydrostatic head of 1,125 psi has been converted to a magnified injection pressure of 2,533 psi, a differential of 1,408 psi.

If it is desired to alter the injection pressure, different sized plungers or connecting rods may be used. In addition, as noted above, any particular liquid exhibiting a sufficient hydrostatic pressure gradient may be used as the fluid that provides the initial pressure above upper plunger 30. The height of the column of liquid 52 may be maintained at a specified level in order to increase or decrease the initial pressure exerted. In some fields where a conventional pump cannot provide sufficiently high injection pressures, the present invention, as evidenced by the example above, can provide such injection pressures in the range of one to two thousand, or more, pounds per square inch increases over the initial pressure exerted by the column of liquid 52. This is especially useful in those fields where the injection or disposal zones exhibit hydrostatic pressure gradients which are in excess of 0.5 psi/ft of depth. Indeed, the present invention's benefits increase as injection pressure approaches fracture gradient (0.7 to 1 psi/ft or more). Alternatively, the present invention may be used in fields where the injection pressure gradient of the disposal zone is less than 0.5 psi/ft with the expectation that injection pressure will increase as the well scales up, builds up pore pressure, etc. This is not unlikely in low permeability injection zones for which this device is advantageously suited.

As described above, and as shown in the above example, the present invention provides a simple system for providing sufficiently high injection pressures. It should be apparent that the present invention may be used to increase efficiency and production, to lower production, disposal, and equipment costs, and to extend the overall commercial life of hydrocarbon producing fields that are currently uneconomic for production, either because of unsuitable water disposal zones subsurface or due to practical limitations of existing equipment.

It will be apparent to those skilled in the art that various modifications and variations can be made in the present invention without departing from the spirit or scope of the invention. Thus, it is intended that the present invention cover the modifications and variations of this invention that are within the scope of the appended claims and their equivalents.

We claim:

1. An apparatus for multiplying a hydrostatic head of a column of liquid into a magnified injection pressure for injecting water, subsurface, in a subterranean well comprising:

a casing having two spaced intervals and extending from a ground surface downwardly within the subterranean well such that a first of said two spaced intervals communicates with a producing zone and a second of said two spaced intervals communicates with a disposal zone;

a pump, disposed in said casing, having an upper plunger and a lower plunger, said upper plunger coupled to said lower plunger and said upper plunger having a surface area larger than a surface area of said lower plunger, said pump reciprocable through an upstroke and a downstroke;

a seal disposed within said casing between said first of said two spaced intervals and said second of said two spaced intervals, wherein said casing and said seal are configured to permit produced water to collect above said seal;

an input disposed between said lower plunger and said seal, said input responsive to said upstroke of said pump to permit unidirectional flow of a portion of said produced water into said pump below said lower plunger to form a column of produced water; and an output in fluid flow communication with said input and said pump, said output responsive to said downstroke of said pump to permit unidirectional flow of said column of produced water at the magnified injection pressure into said casing below said seal.

2. An apparatus according to claim 1, further comprising:

a pump drive located at the ground surface and coupled to said upper plunger to reciprocate said pump through said upstroke and said downstroke.

3. An apparatus according to claim 1, further comprising:

a tubing extending from the ground surface downwardly within said casing.

4. An apparatus according to claim 3, wherein said pump is disposed within said tubing.

5. An apparatus according to claim 4, wherein the column of liquid is disposed in said tubing above said upper plunger.

6. An apparatus according to claim 5, further comprising:

a surge tank in fluid flow communication with said tubing, said surge tank maintaining a height of the column of liquid in said tubing, above said upper plunger.

7. An apparatus according to claim 4, further comprising:

an upper barrel and a lower barrel disposed in said tubing, wherein said upper plunger is sealingly disposed in said upper barrel and said lower plunger is sealingly disposed in said lower barrel.

8. An apparatus according to claim 4, wherein said upper plunger and said lower plunger are sealingly disposed in said tubing.

9. An apparatus according to claim 4, further comprising:

a port disposed in said tubing and between said upper plunger and said lower plunger, said port permitting a portion of the produced water to enter said tubing on said upstroke of said pump and to exit said tubing on said downstroke of said pump.

10. An apparatus according to claim 1, further comprising:

a valve assembly having an upper and a lower portion, wherein said input is disposed in said upper portion and said output is disposed in said lower portion.

11. An apparatus according to claim 10, wherein said input and output are caged ball valves.

12. An apparatus according to claim 1, further comprising:

a connecting rod, said upper plunger being coupled to said lower plunger by said connecting rod.

13. An apparatus according to claim 1, wherein said produced water and produced hydrocarbons collect above said seal and separate by gravity, thereby allowing the produced hydrocarbons to flow upwardly to the ground surface.

14. A method for producing gas, with little or no water, to a ground surface from a subterranean well, the subterranean well traversing a producing zone and a disposal zone, the method comprising:

reciprocating a pump through an upstroke, said pump disposed within a casing disposed in the subterranean well and having an upper plunger coupled to a lower plunger with said upper plunger having a surface area larger than a surface area of said lower plunger, so that produced water from the producing zone flows into said pump to form a column of produced water below said lower plunger;

allowing produced water and produced gas to collect above said seal disposed in the subterranean well, and to separate by gravity thereby allowing the produced gas to flow upwardly to the ground surface; and reciprocating said pump through a downstroke so that the column of produced water flows at a magnified injection pressure into said casing below said seal for disposal in the disposal zone, wherein a hydrostatic head of a column of liquid above said upper plunger is multiplied by said pump into the magnified injection pressure.

15. The method of claim 14, wherein produced water flows into said pump through an input disposed between said lower plunger and said seal, wherein said input is responsive to said upstroke of said pump.

16. The method of claim 14, wherein the column of produced water flows into said casing through an output, said output in fluid flow communication with said input and said pump, wherein said output is responsive to said downstroke of said pump.

17. An apparatus for multiplying a hydrostatic head of a column of liquid into a magnified injection pressure for injecting water, subsurface, in a subterranean well comprising:

a casing having two spaced intervals and extending from a ground surface downwardly within the subterranean well such that a first of said two spaced intervals communicates with a producing zone and a second of said two spaced intervals communicates with a disposal zone, the producing zone including hydrocarbons and water;

a tubing extending from the ground surface downwardly within said casing, said tubing and said casing forming a casing-tubing annulus, whereby produced hydrocarbons flow through said casing-tubing annulus to the ground surface;

a pump disposed in said casing and coupled to said tubing, said pump having an upper plunger and a lower plunger, said upper plunger coupled to said lower plunger and said upper plunger having a surface area larger than a surface area of said lower plunger, said pump reciprocable through an upstroke and a downstroke;

a seal disposed within said casing between said first of said two spaced intervals and said second of said two spaced intervals, wherein said casing and said seal are configured to permit produced water to collect above said seal;

an input disposed between said lower plunger and said seal, said input responsive to said upstroke of said pump to permit unidirectional flow of a portion of said produced water into said pump below said lower plunger to form a column of produced water; and an output in fluid flow communication with said input and said pump, said output responsive to said downstroke of said pump to permit unidirectional flow of said column of produced water at the magnified injection pressure into said casing below said seal.

18. An apparatus according to claim 17, wherein said pump is disposed within said tubing.

19. An apparatus according to claim 18, wherein the column of liquid is disposed in said tubing above said upper plunger.

20. An apparatus according to claim 18, further comprising:

an upper barrel and a lower barrel disposed in said tubing, wherein said upper plunger is sealingly disposed in said upper barrel and said lower plunger is sealingly disposed in said lower barrel.

21. An apparatus according to claim 18, wherein said upper plunger and said lower plunger are sealingly disposed in said tubing.

22. An apparatus according to claim 18, further comprising:

a port disposed in said tubing and between said upper plunger and said lower plunger, said port permitting a portion of the produced water to enter said tubing on said upstroke of said pump and to exit said tubing on said downstroke of said pump.

23. An apparatus according to claim 17, wherein said produced water and produced hydrocarbons collect above said seal and separate by gravity, thereby allowing the produced hydrocarbons to flow upwardly to the ground surface.

* * * * *